US007651207B2

(12) United States Patent
Hatasa et al.

(10) Patent No.: US 7,651,207 B2
(45) Date of Patent: Jan. 26, 2010

(54) METHOD FOR CONTROLLING LIGHT EMITTING PORTION FOR LIQUID CONTAINER AND PRINTING APPARATUS

(75) Inventors: Nobuyuki Hatasa, Kawasaki (JP); Kenjiro Watanabe, Tokyo (JP); Kenji Kitabatake, Kawasaki (JP); Kimiyuki Hayasaki, Yokohama (JP); Takayuki Ochiai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 582 days.

(21) Appl. No.: 11/455,864

(22) Filed: Jun. 20, 2006

(65) Prior Publication Data

US 2006/0290756 A1 Dec. 28, 2006

(30) Foreign Application Priority Data

Jun. 23, 2005 (JP) ..... 2005-183982

(51) Int. Cl.
*B41J 2/175* (2006.01)

(52) U.S. Cl. ..... 347/86

(58) Field of Classification Search ..... 347/7, 347/19, 86

See application file for complete search history.

(56) References Cited

U.S. PATENT DOCUMENTS

| | | | | |
|---|---|---|---|---|
| 4,937,591 | A | 6/1990 | Miyake et al. | 346/107 R |
| 6,422,675 | B1 * | 7/2002 | Tomomatsu | 347/7 |
| 6,547,363 | B1 | 4/2003 | Shinada et al. | 347/19 |
| 6,619,776 | B2 * | 9/2003 | Yoshiyama et al. | 347/7 |
| 7,249,835 | B2 * | 7/2007 | Hoshino et al. | 347/102 |

FOREIGN PATENT DOCUMENTS

| | | | |
|---|---|---|---|
| JP | 61-264362 | A | 11/1986 |
| JP | 01-103462 | A | 4/1989 |
| JP | 4-275156 | | 9/1992 |
| JP | 05-249907 | A | 9/1993 |
| JP | 09-203919 | A | 8/1997 |
| JP | 2002-301829 | | 10/2002 |
| JP | 2003-337513 | A | 11/2003 |
| WO | WO 01/05596 | A1 | 1/2001 |

* cited by examiner

*Primary Examiner*—Anh T. N. Vo
(74) *Attorney, Agent, or Firm*—Fitzpatrick, Cella, Harper & Scinto

(57) ABSTRACT

A variation in brightness among light emitting portions provided in a plurality of liquid containers can be reduced to decrease power required to drive the light emitting portions, while allowing the light emitting portions to appropriately function as reporting units. Thus, to illuminate the light emitting portions provided in the plurality of ink tanks, a driving pulse for each of the plurality of light emitting portions is modulated to control rates of a light emission period and a light emission halted period during a unit time. Further, the light emission period of at least one of the plurality of light emitting portions overlaps the light emission halted period of at least another one of the plurality of light emitting portions.

10 Claims, 10 Drawing Sheets

METHOD FOR CONTROLLING LIGHT EMITTING PORTION FOR LIQUID CONTAINER AND PRINTING APPARATUS

BACKGROUND OF THE INVENTION

1. Field of the Invention

The present invention relates to a method for controlling a light emitting portion for a liquid container as well as a printing apparatus, and more specifically, to a method for controlling a light emitting portion for a liquid container which can individually control light emitting portions such as LEDs provided in a plurality of liquid containers, and a printing apparatus using a plurality of liquid containers comprising light emitting portions.

2. Description of the Related Art

With the recent prevalence of digital cameras, printers (printing apparatuses) have more often been connected directly to digital cameras without the mediation of PCs (Personal Computers). Moreover, card type information storage media for digital cameras have more often been installed directly in printers so that data in the information storage media can be transferred to the printer for printing (non PC printing).

As a method for determining the amounts of ink remaining in ink tanks (liquid containers) provided in a printer, a technique is well known which checks the amount on a monitor via a PC. In connection with the non PC printing, there has been a growing need to determine the amounts of ink remaining in the ink tanks without the mediation of the PC. By determining that only a small amount of ink remains in an ink tank, users can replace the ink tank with a new one, for example, before starting printing. This makes it possible to prevent a printing operation from being substantially disabled by the insufficient amount of ink before the operation is completed.

A configuration using display elements such as LEDs has been known as means for reporting such a condition of the ink tank to the user. Japanese Patent Application Laid-Open No. 4-275156 describes a configuration in which two LEDs are provided for each of the ink tanks integrated with a print head to illuminate at two levels depending on the ink remaining amount. Japanese Patent Application Laid-Open No. 2002-301829 also describes a configuration in which each ink tank is provided with a lamp that illuminates depending on the ink remaining amount. Japanese Patent Application Laid-Open No. 2002-301829 also describes a configuration in which each of four ink tanks used in the printing apparatus is provided with a lamp that indicates the ink remaining amount.

On the other hand, the need for the improved quality of printed images has led to the use of ink such as light magenta or cyan which has a lower concentration, in addition to conventional four colors (black, yellow, magenta, and cyan). Moreover, what is called special color ink such as red or blue has more often been used. More ink tanks are now mounted in printers in association with the types of inks used.

Owing to manufactural variations among light emitting portions using light emitting elements such as LEDs, the quantity of emitted light varies among the plurality of LEDs even if the same current is passed through the same circuit. Thus, if LEDs are provided for the respective ink tanks provided in the printer, the quantity of light emitted by these LEDs may vary.

The ink tank may be provided with a light emitting portion, a light guiding portion, and a display portion so that light from the light emitting portion is guided through the light guiding portion to the display portion located where it is easily seen by the user. However, in this case, manufactural variations among the light guiding portions may vary their light guiding characteristics and thus the quantity of light guided from the light emitting portion to the display portion. For example, it is assumed that the printer has a mixture of ink tanks with LEDs illuminating brightly and ink tanks with LEDs illuminating darkly and that the LEDs provided in the plurality of ink tanks are all blinking. In this case, the user may erroneously determine that a large amount of ink still remains in the ink tanks with the LEDs illuminating brightly and that only a small amount of ink remains in the ink tanks with the LEDs illuminating darkly. The users may thus determine that a variation in brightness among the LEDs for the ink tanks has some meaning. This may impair the functions of the reporting means using the LEDs.

The recent printers are also desired to consume reduced power for an ecological reason. Moreover, since portable computers called a notebook type are commonly used as PCs (Personal Computers) serving as host devices, mobile printers have appeared which can be connected to these-notebook PCs. Many mobile printers need to be driven by a limited power source such as batteries instead of a common domestic power source that can be inexhaustibly used by printers. Thus, electronic control modules constituting these mobile printers are desired to further save power.

SUMMARY OF THE INVENTION

An object of the present invention is to provide a method for controlling a light emitting portion for a liquid container as well as a printing apparatus, the method and apparatus being able to reduce a variation in brightness among light emitting portions provided in a plurality of liquid containers to decrease power required to drive the light emitting portions, while allowing the light emitting portions to appropriately function as reporting means.

In a first aspect of the present invention, there is provided a method for controlling a light emitting portion for a liquid container in a printing apparatus that can print an image using a liquid supplied from a plurality of liquid containers, the method individually controlling the light emitting portions provided in the respective liquid containers, the method comprising:

to cause the plurality of light emitting portions to emit light, modulating a driving pulse for each of the plurality of light emitting portions to control rates of a light emission period and a light emission halted period during a unit time; wherein the light emission period of at least one of the plurality of light emitting portions is in the light emission halted period of another at least one of the plurality of light emitting portions.

In a second aspect of the present invention, there is provided a printing apparatus that can print an image using a liquid supplied from a plurality of liquid containers and that can individually control light emitting portions provided in the respective liquid containers, the apparatus comprising:

a control portion which, to cause the plurality of light emitting portions to emit light, modulates a driving pulse for each of the plurality of light emitting portions to control rates of a light emission period and a light emission halted period during a unit time, and which controls the light emission period of at least one of the plurality of light emitting portions to be in the light emission halted period of another at least one of the plurality of light emitting portions.

According to the present invention, to cause the light emitting portions provided in the plurality of liquid containers to emit light, the driving pulse for each light emitting portion is modulated to control the rates of the light emission period and the light emission halted period during the unit time. Moreover, the light emission period of at least one of the plural light emitting portions is set to overlap the light emission halted period of another at least one of the plural light emitting portions. This makes it possible to reduce a variation in brightness among the light emitting portions provided in the plurality of liquid containers to decrease power required to drive the light emitting portions, while allowing the light emitting portions to appropriately function as reporting means.

The above and other objects, effects, features and advantages of the present invention will become more apparent from the following description of embodiments thereof taken in conjunction with the accompanying drawings.

DETAILED DESCRIPTION OF THE PREFERRED EMBODIMENTS

Embodiments of the present invention will be described below with reference to the drawings.

First Embodiment

Figure 1A:
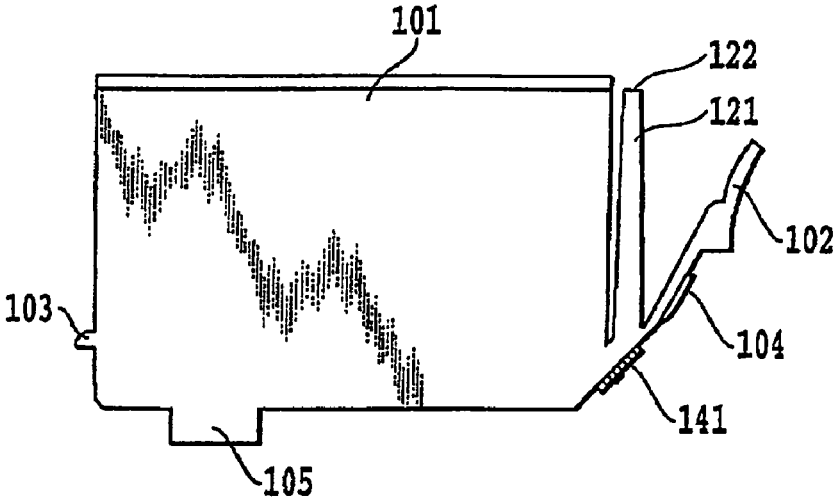
FIG. 1A is a side view of an ink tank in accordance with a first embodiment of the present invention.
Figure 1B:
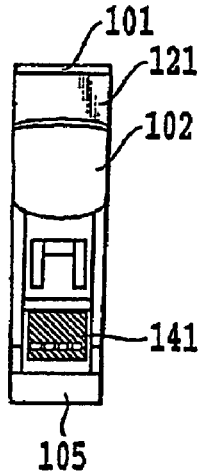
FIG. 1B is a front view of the ink tank in FIG. 1A.
Figure 1C:
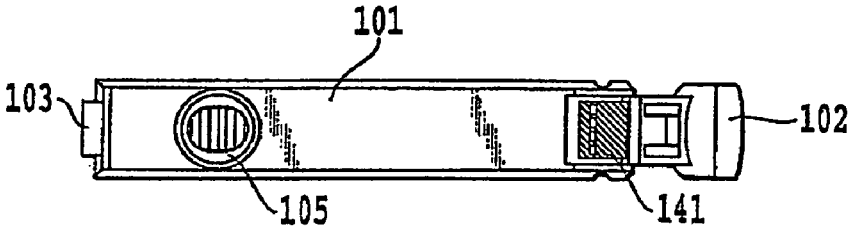
FIG. 1C is a bottom view of the ink tank in FIG. 1A.

FIGS. 1A, 1B, and 1C are a side view, a front view, and a bottom view of an ink tank (liquid container) in accordance with a first embodiment of the present invention.

An ink tank 101 in accordance with the present embodiment has a supporting portion 102 supported at the bottom of a front side of the ink tank. The support portion 102 is formed of resin and integrated with a sheath of the ink tank 101. The support portion 102 can be displaced around a supported portion when, for example, the ink tank is installed in a tank holder described later. The ink tank 101 has a first engaging portion 103 and a second engaging portion 104 (in the present example, the second engaging portion 104 is integrated with the support portion 102) provided on rear and front surfaces, respectively, and which can engage with locking portions of the tank holder. This engagement ensures installation of the ink tank 101 in the tank holder.

An ink supply port 105 is formed in the bottom surface of the ink tank 101 and couples to an ink introduction port in a print head described later when the ink tank 101 is installed in the tank holder. A base is provided in a part of the ink tank 101 in which its bottom and front surfaces are joined together. The base may be shaped like a chip or a plate. In the description below, the base is denoted by reference numeral 141 as a substrate. A light guiding portion 121 is provided between the support portion 102 and the sheath of the ink tank 101. Like the support portion 102, the light guiding portion 121 is formed of resin and integrated with the sheath of the ink tank 101.

With reference to FIGS. 2A, 2B, 3A, and 3B, description will be given of the configuration and functions of the light guiding portion 50 in accordance with the present embodiment.

Figure 2A:
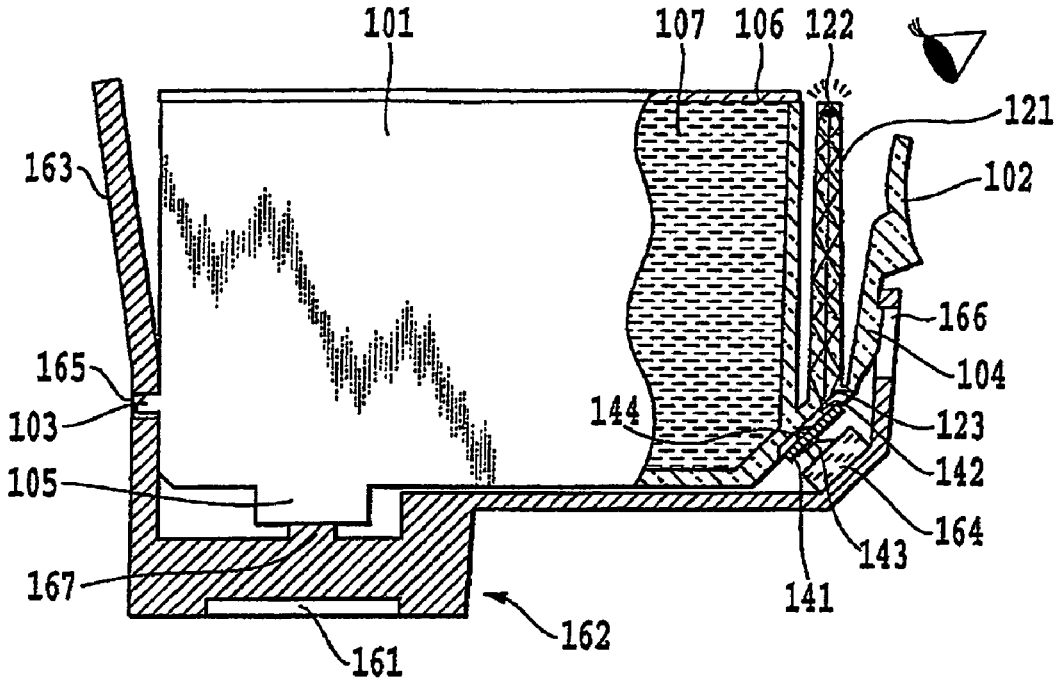
FIG. 2A is a schematic side view illustrating the functions of a light guiding portion placed in the ink tank in FIG. 1A.
Figure 2B:
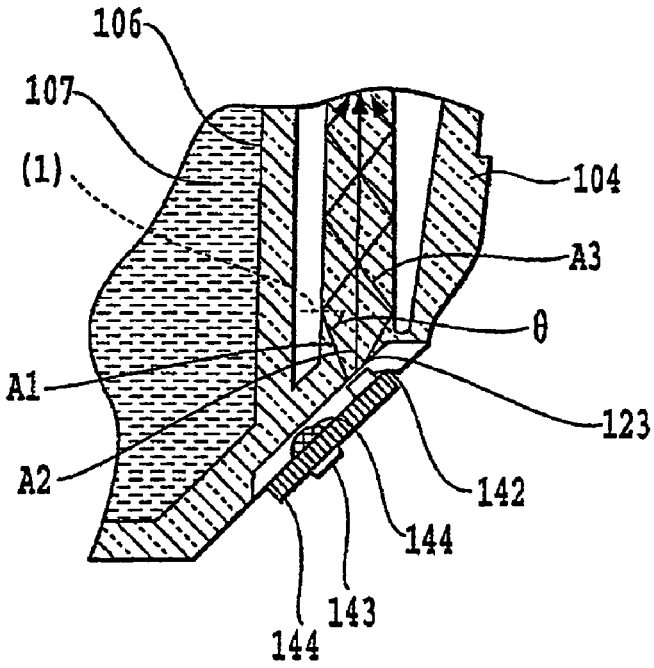
FIG. 2B is an enlarged view of an essential part of the light guiding portion in FIG. 2A.
Figure 3A:
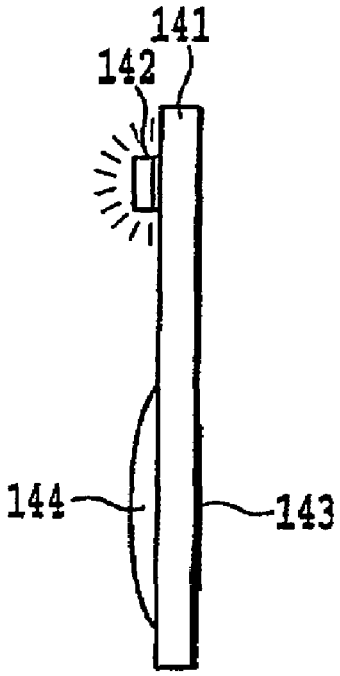
FIG. 3A is a side view of a substrate provided in the ink tank shown in FIG. 1.
Figure 3B:
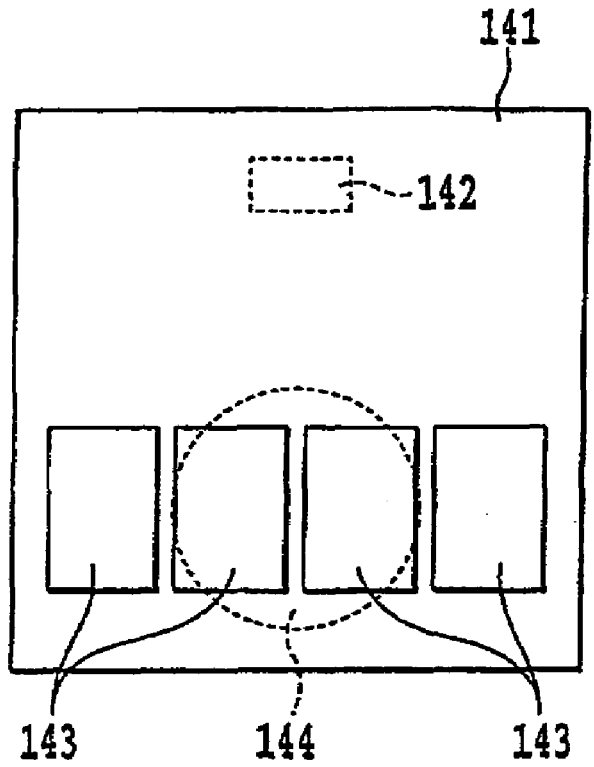
FIG. 3B is a front view of the substrate in FIG. 3A.

FIG. 2A is a schematic side view schematically illustrating the functions of the light guiding portion 121, provided in the ink tank 101. FIG. 2B is an enlarged view of an essential part of the light guiding portion 121. FIGS. 3A and 3B are a side view and a front view showing an example of the substrate 141, attached to the ink tank 101.

A first locking portion 165 and a second locking portion 166 are provided in a holder 163 integrated with a print head unit 162 comprising a print head 161. The locking portions 165 and 166 are engaged with the first locking portion 103 and second locking portion 104, respectively, of the ink tank 101 to fixedly install the ink tank 101 in the holder 163. At this time, a contact 164 provided on the holder 163 comes into contact with and is electrically connected to an electrode pad 143 (FIG. 3A) on the substrate 141, provided in the ink tank 101. The electrode pad 143 is provided on a surface of the substrate 141 which is faces the exterior.

An ink containing chamber 106 and a negative pressure generating material containing chamber (not shown) are provided inside the ink tank 101. The ink containing chamber 106 is located in the front of the ink tank 101 to house ink 107. The negative pressure generating material containing chamber is located in the rear of the ink tank 101 in communication with the ink supply port 105 to house a negative pressure generating member (not shown). Ink is stored in the ink containing chamber 106 as it is. The negative pressure generating material containing chamber houses an ink absorbent such as a sponge or a fiber aggregate (hereinafter referred to as a "porous member" for convenience). The porous member exerts an appropriate negative pressure on the ink. The negative pressure is equal to a force required to hold ink meniscus formed in an ink ejection nozzle portion of the print head 161; the negative pressure is thus sufficient to present leakage of ink from an ink ejecting portion. The negative pressure is within the range that allows the print head 161 to perform an ink ejecting operation.

The internal configuration of the ink tank 101 is not limited to the one in which the ink tank 101 is divided into the housing chamber for the porous member and the housing chamber housing the ink as it is. For example, the whole internal space in the ink tank may be substantially filled with the porous material. The negative pressure generating means may be, for example, a bag-like member into which the ink can be filled, instead of the porous member. The bag-like member is formed of an elastic material such as rubber which generates a tension in a direction in which its internal volume is increased. The ink is filled into the bag-like member as it is so that tension generated by the bag-like member exerts a negative pressure on the ink inside the bag-like member. The negative pressure generating means may be a flexible member. The flexible member constitutes at least a part of a wall portion forming the space that accommodates the ink; the ink is accommodated in this space as it is. A spring force is exerted on the flexible member to generate a negative pressure.

A light emitting portion 142, a storage element 144B (see FIG. 6), and a control element 144A (see FIG. 6) are provided on a surface of the substrate 141 which faces the interior of the ink tank 101; the light emitting portion 142 including a light emitting element such as a LED to generate visible light, the storage element 144B can store information, and the control element 144A controls the light emitting portion 142. In the present example, the storage element 144B and the control element 144A constitute an integral IC package 144 provided on the substrate 141. The control element 144A in the IC package 144 controls light emission from the light emitting portion 142 on the basis of an electric signal supplied via the contact 164 and pad 143. To suppress a decrease in the quantity of light when the light guiding portion 121 is flooded with light from the light emitting element 142, the substrate 141 is placed so that the light emitting portion 142 is located near an incident surface 123.

FIG. 2B is an enlarged view of neighborhood of the root of the light guiding portion 121 in FIG. 2A. As shown in FIG. 2B, light emitted by the light emitting portion 142 is incident from the incident surface 123, which constitutes a facet of the light guiding portion 121. The light then passes through the light guiding portion 121 to reach the display portion 122. The display portion 122 optically displays information to a user. Visible light emitted by the light emitting portion 142 is diffuse light and thus has a plurality of rays as shown by arrows A1 to A3 in FIG. 2B.

In the present example, polypropylene is adopted as a material for the sheath of the ink tank 101. The light guiding portion 121 is formed of the same material as that of the ink tank 101 because it is integrated with the ink tank 101. Since polypropylene has a refractive index of 1.49, whereas air has a refractive index of 1.0, the critical refraction angle between polypropylene and air is about 43° on the basis of the Snell's rule ($\sin\theta 1 = n2 \sin\theta 2$). Accordingly, a ray having an incident angle $\theta$ of at least 43° at a point (1) in FIG. 2B is totally reflected by the interface between polypropylene (light guiding portion 121) and air. This ray is repeatedly totally reflected in the light guiding portion 121 as shown by arrows A1 and A3 before reaching the display portion 122.

The light guiding portion 121 provided in the ink tank 101 enables the light emitting element 142 and display portion 122 to be individually arranged at the optimum positions without the need for a power source, lead wires through which signals are communicated, or the like. This allows the display portion 122 to be more freely placed so that the user can easily determine the amount of ink remaining in the ink tank. By viewing the light emission state of the display portion 122, the user can obtain predetermined information on the ink tank 101. The light guiding portion 121 integrated with the sheath of the ink tank 101 allows the display portion 122 to be located without increasing costs.

The predetermined information on the ink tank 101 includes, for example, whether or not the ink tank 101 is properly installed (whether or not the installation is perfect), whether or not the ink tank 101 is installed at the proper position (whether or not the ink tank is installed at a predetermined installation position on the holder which is preset in association with the ink color), and whether or not ink remains (whether or not a sufficient amount of ink remains). This information can be presented on the basis of the presence of light emission from the display portion 122 or the condition of the light emission (blinking or the like).

During the manufacture of the ink tank 101, the light emitting portion 142 is checked for light emission and at the same time for the quantity of emitted light. To check for the quantity of emitted light, a sensor detects the intensity of light having passed from the light emitting portion 142 through the light guiding portion 121 to the display portion 122. The intensity of light is then determined to be at one of four levels; rank information is obtained. The rank information on each ink tank 101 is then written to the storage element 144B in the IC package 144 provided in that ink tank 101. In the present example, the check on the quantity of emitted light thus involves the steps of detecting the intensity of light, ranking the intensity, and writing the rank information. Simultaneously with writing of the rank information into the storage element 144B, the following various pieces of information are written into the storage element 144B: the color of the ink filled into the ink tank 101 (color ID), an individual code unique to the ink tank 101, the date when the ink was filled into the ink tank 101, and the amount of filled ink.

Figure 4:
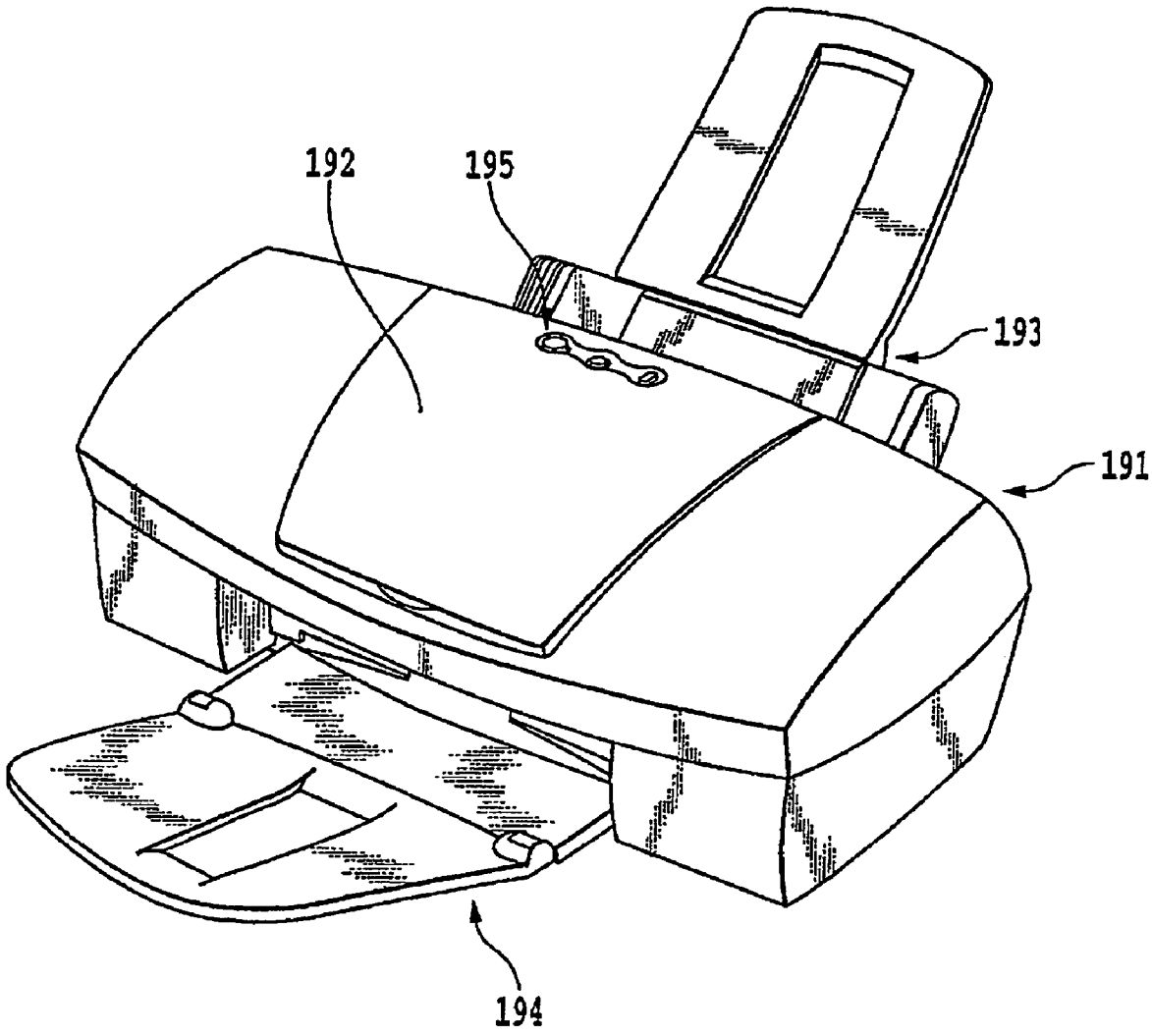
FIG. 4 is a perspective view of appearance of an ink jet printer that can execute printing via the ink tank in FIG. 1A.
Figure 5:
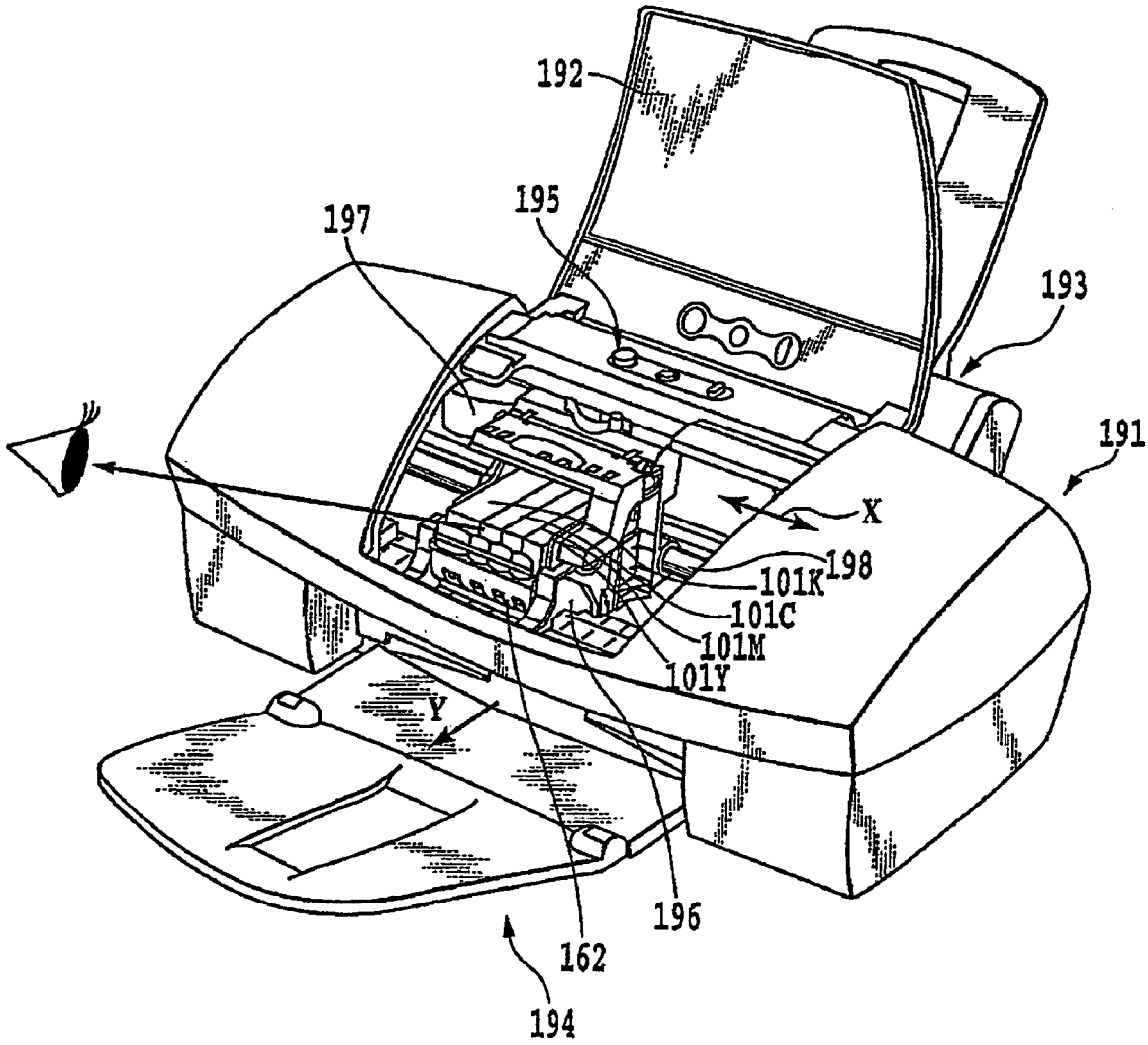
FIG. 5 is a perspective view showing that a main body cover of the ink jet printer in FIG. 4 is open.

FIG. 4 is a perspective view of appearance of an ink jet printer (ink jet printing apparatus) 191 in which the above ink tanks are installed for printing. FIG. 5 is a perspective view of the printer 191 in which a main body cover 192 shown in FIG. 4 is open. The ink jet printer described in the present embodiment is a color printer in which the ink tanks 101 into which black, yellow, magenta, and cyan inks are filled.

As shown in FIG. 4, the printer 191 in accordance with the present embodiment comprises a printer main body, a sheet discharging tray 194, and an automatic sheet feeder (ASF) 193. In the printer main body, an essential part of the printer is covered with the main body cover 192 and other case portions. The essential part of the printer includes a mechanism that carries out printing while moving a carriage on which the print head and ink tanks are mounted. The sheet discharging tray 194 is provided in front of the printer main body. The automatic sheet feeder (ASF) 193 is provided behind the printer main body. An operation portion 195 is provided with a display that displays the condition of the printer with the main cover 192 closed or open, a power switch, and a reset switch.

With the main body cover 192 open, the user can view the area within which the carriage moves and its surrounding areas as shown in FIG. 5. The following are mounted on the carriage 196; a print head unit 162, and a black tank 101K, a yellow tank 101Y, a magenta tank 101M, and a cyan tank 101C (these ink tanks may hereinafter collectively denoted by the same reference numeral "101"). Actually, when the main cover 192 is opened, a sequence is executed which automatically moves the carriage 196 to an almost central position (hereinafter referred to as an "ink tank replacement position") shown in FIG. 5. At the ink tank replacement position, the user can perform, for example, an operation of replacing any ink tank with a new one.

In the printer in accordance with the present embodiment, the print head unit 162 is provided with print heads (not shown) in chip forms which correspond to the color inks.

While the print head 162 is moving, together with the carriage 196, in a main scanning direction shown by arrow X, the print heads, corresponding to the ink colors, eject the inks to print a medium such as a sheet to carry out printing as described below. The carriage 196 slidably engages with a shaft 198 extending in its main scanning direction. The carriage 196 is reciprocated in the main scanning direction by a carriage motor and a mechanism for transmitting the driving force of the carriage motor. The print heads, corresponding to the inks K, Y, M, and C, eject the inks on the basis of ejection data sent by a control circuit in the printer main body via a flexible cable 197. A sheet feeding mechanism can intermittently convey the print medium (not shown) fed by the automatic sheet feeder 193 to the sheet feeding tray 194; the sheet feeding mechanism includes a sheet feeding roller and a sheet discharging roller. The print head unit 162 integrated with the tank holder is releasably installed on the carriage 196. The ink tanks 101 (101K, 101C, 101M, and 101Y) are individually releasably installed in the print head unit 162.

During a printing operation, the print heads eject the inks while moving in the main scanning direction. Each print head thus prints an area corresponding to the width over which a plurality of ejection openings are arranged in the print head. After the current printing scan and before the next, the sheet feeding mechanism conveys the print medium by a predetermined amount in a sub-scanning direction (which crosses the main scanning direction) shown by arrow Y. Such a printing scan and a conveying operation are repeated to sequentially print images on the print medium.

An ejection recovery unit is provided at the terminal position of movement range of the print head, which moves together with the carriage 196; the ejection recovery unit includes a cap that covers a surface of each print head on which ejection openings are formed. A recovery process for maintaining a proper ink ejection condition can be executed by moving the print heads with respect to the position where the recovery unit is provided, at predetermined time intervals. The recovery process may include, for example, preliminary ejection that allows ink not contributing to image printing to be ejected from the ejection openings.

Connectors 164 corresponding to the ink tanks 101 are provided in the print head unit 162, comprising the tank holder, in which the ink tanks 101 can be releasably installed. Each of the connectors 164 comes into contact with a pad 143 on the substrate 141 of the corresponding installed ink tank 101. This enables the light emitting portion 142, provided in each ink tank 101, to be controllably illuminated, extinguished, or blinked.

Specifically, at the ink tank replacement position, the light emitting portion 142 of the ink tank 101 with an insufficient amount of ink is illuminated or blinked. Light from the light emitting portion 142 passes through the light guiding portion 121 to illuminate or blink the display portion 122. Control can also be performed such that when the ink tank 101 is correctly installed, the light emitting portion 142 of that ink tank 101 is illuminated. Control of the light emitting portion 142 can be performed by sending control data (control signal) from the control circuit in the printer main body to the ink tanks via the flexible cable 197 as is the case with the control of the print heads in connection with ink ejection.

Figure 6:
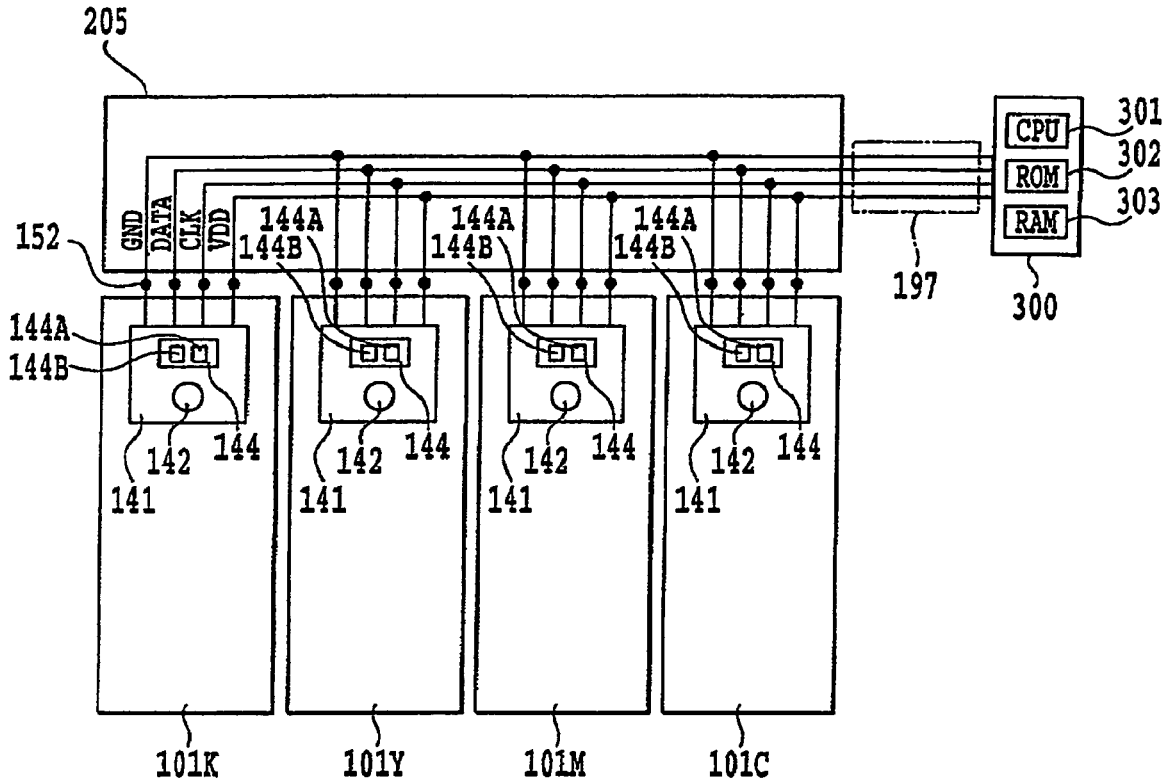
FIG. 6 is a diagram illustrating signal wiring among ink tanks in the ink jet printer shown in FIG. 4.

FIG. 6 is a diagram illustrating signal wiring formed between the ink tanks 101 and a control circuit 300 in the printer main body via the flexible cable 197.

As shown in FIG. 6, four signal lines are connected to each ink tank 101. The common signal lines are connected to the four ink tanks 101 (what is called bus connections). In other words, the signal wiring to each ink tank 101 includes four signal lines, a power signal line "VDD", an earth signal line "GND", a signal line "DATA", and a clock signal line "CLK". The power signal line "VDD" and earth signal line "GND" are wires through which power is supplied to functional elements in the IC package 142. The functional elements include those which drive light emission from the light emitting portion 142 of each ink tank 101. The signal line "DATA" and clock signal line "CLK" are used to send a control signal (control data) or the like from the control circuit 300 to light, extinguish, or blink the light emitting elements 142.

In the present embodiment, description will be given of a configuration using four signal lines as described above. However, the configuration of the signal lines is not particularly limited. For example, another earth connection configuration may be used for the earth signal to omit the earth signal line "GND". Further, the "CLK" and "DATA" signal lines may be composed of a single line. This configuration eliminates the need for the signal line "DATA" for each ink tank. The number of signal lines in the flexible cable 197 can thus be reduced.

The four ink tanks accommodating the respective color inks are mounted in the printer in accordance with the present embodiment. If the signal line "DATA" were provided for each of eight ink tanks mounted in the printer and accommodating the respective color inks, eight signals lines "DATA" would be required. Thus, the total number of signal lines required would be 11, that is, the 8 signal lines "DATA" plus the power signal line "VDD", earth signal line "GND", and clock signal line "CLK", which are common to the ink tanks. In this case, the wiring in the flexible cable 197 might be complicated to increase costs. Accordingly, the bus connections in accordance with the present invention are economically advantageous particularly for printers in which a plurality of ink tanks are mounted.

The control circuit 300 in the printer performs data processing for the printer and operation control including the control of light emission from the light emitting portion 142. Specifically, a CPU 301 executes processes described later in accordance with programs stored in a ROM 302. A ROM 303 is used as a work area in which the CPU 301 executes processes. The IC package 144, provided on the substrate 141 on each ink tank 101, operates the light emitting element 142 on the basis of a signal from the control circuit 300 input via the four signal lines.

Figure 7:
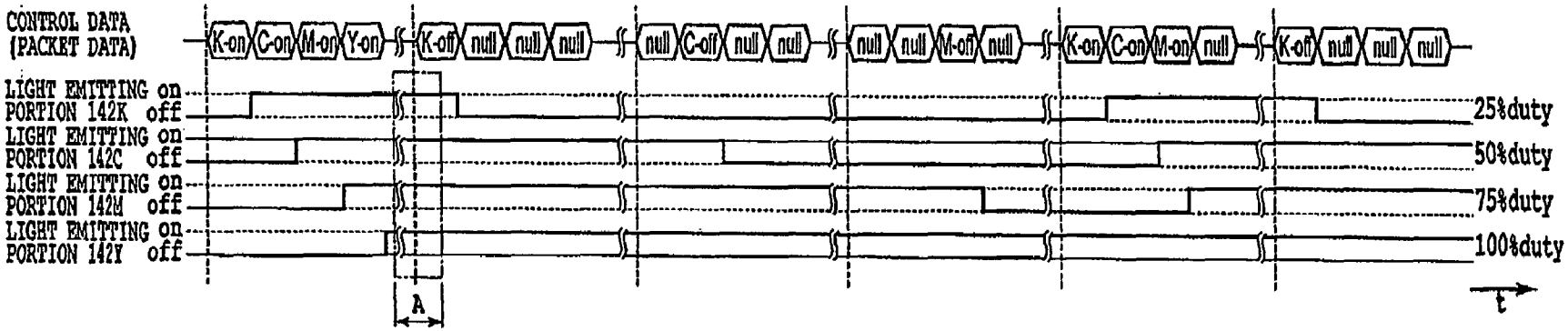
FIG. 7 is a timing chart illustrating an example of the relationship between a control signal from a control circuit in the ink jet printer shown in FIG. 4 and light emission timings for the light emitting portions provided in the ink tanks.
Figure 8:
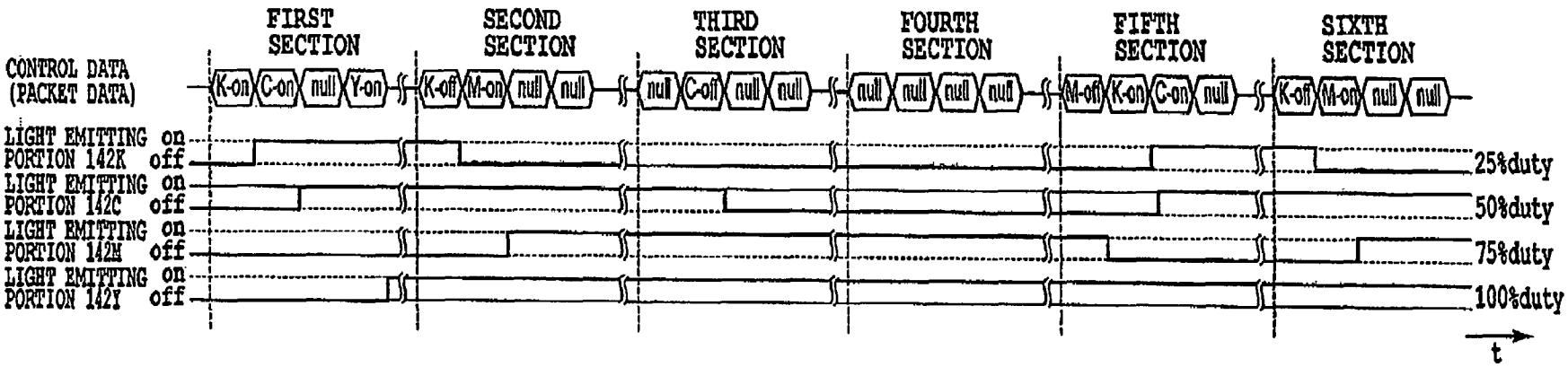
FIG. 8 is a timing chart illustrating another example of the relationship between the control signal from the control circuit in the ink jet printer shown in FIG. 4 and the light emission timings for the light emitting portions provided in the ink tanks.

FIGS. 7 and 8 are timing charts illustrating different examples of control of light emission from the light emitting portion 142.

Specifically, FIGS. 7 and 8 are timing charts illustrating the relationship between packet data (hereinafter simply referred to a "packet" or "packets") sent by the printer control circuit 300 through the signal line "DATA" as control data and timings for light emission from the light emitting portion 142 of each ink tank 101. More specifically, FIG. 7 is a timing chart indicating that a driving pulse for the light emitting portion 142 of each ink tank 101 is controllably modulated to adjust the quantity of light emitted by the light emitting portion 142. FIG. 8 is a timing chart indicating that the quantity of light emitted by the light emitting portion 142 is adjusted as shown in FIG. 7 and that light emission periods and halted periods of a plurality of light emitting portions 142 are associatively set.

A packet sent by the printer control circuit 300 consists of a set of a color ID identifying the ink tank corresponding to one of the plural ink colors and a signal that controllably turns on and off the light emitting portion 142. In the description below, the light emitting portions of the black, cyan, magenta, and yellow tanks are denoted by 142K, 142C, 142M, and 142Y.

In the example in FIG. 7, the packets "K-on", "C-on", "M-on", and "Y-on" are shown in this order from the left end of the figure. In these packets, "K", "C", "M", and "Y" are color IDs identifying the black, cyan, magenta, and yellow tanks, respectively. "on" is a signal that illuminates (turns on) the light emitting portion. Accordingly, these packets are instructions for illuminating the light emitting portions 142K, 142C, 142M, and 142Y of the black, cyan, magenta, and yellow tanks. "off" in the subsequent packet "K-off" is a signal that extinguishes (turns off) the light emitting portion. Accordingly, this packet is an instruction for extinguishing the light emitting portion 142K of the black tank. "null" in the subsequent packet indicates that no signals are present.

These instructions are receives by the control element 144A in the IC package 144 in each ink tank 101. The control element 144A in each IC package 144 first checks the color ID in the packet sent by the control circuit 300 against the color ID written into the storage element 144B (color ID of the ink filled into the ink tank). If the color IDs are not identical, the control element 144A does not respond to the illumination/extinction (on/off) instruction paired with the color ID of the packet. If the color IDs are identical, the control element 144A illuminates or extinguishes the light emitting portion 142 in accordance with the illumination/extinction (on/off) instruction paired with the color ID of the packet. The control circuit 300 can thus identify the ink tank 101 on the basis of the color ID of the packet to illuminate or extinguish the light emitting portion 142 of the identified ink tank 101. Consequently, even the bus connections shown in FIG. 6 enable the light emitting portions 142K, 142C, 142M, and 142Y to be individually controllably illuminated or extinguished.

As previously described, the light emitting elements such as LEDs in the light emitting portions 142 may emit a varying quantity of light owing to manufactural variations even if "the same current is passed through the same circuit". Further, as previously described, manufactural variations among the light guiding portions 121 may vary their light guiding characteristics, thus reducing the quantity of guided light in some light guiding portions 121. This may result in a significant variation in the quantity of emitted light among the display portions 122.

Thus, the present embodiment writes rank information into the storage element 144B in the IC package 144. Then, on the basis of the written rank information, the control circuit 300 controls the light emitting portion 142 so that a variation in the brightness of the display portion 122 of each ink tank is reduced. Specifically, for those ink tanks which have relatively bright display portions 122, the driving pulse for the light emitting portion 142 is shortened. On the contrary, for those ink tanks which have relatively dark display portions 122, the driving pulse for the light emitting portion 142 is elongated. This reduces a variation in the brightness of the display portion 122 among the ink tanks.

More specifically, the control element 144A in the IC package 144 has a function for returning the color ID and rank information (in the present example, four ranks) on the quantity of light which are stored in the storage element 144B. The color ID and the light quantity rank information are received by the control circuit 300. For those ink tanks which have higher light quantity ranks, that is, those ink tanks which have relatively bright display portions 122, the control circuit 300 reduces the illumination period (increases the extinction period) for the light emitting portion 142 during a predetermined unit period in order to allow the light emitting portion 142 to emit darker light. On the contrary, for those ink tanks which have lower light quantity ranks, that is, those ink tanks which have relatively dark display portions 122, the control circuit 300 increases the illumination period (reduces the extinction period) for the light emitting portion 142 during the predetermined unit period in order to allow the light emitting portion 142 to emit brighter light.

The control circuit 300 in the present example controls light emission duty (rate of the unit period taken up by the light emission period) to 25, 50, 75, and 100% depending on the four-rank information. A lower light emission duty allows the light emitting portion 142 to appear to human eyes to emit darker light. In the example in FIG. 7, the control circuit 300 controls the light emitting portion 142K of the black tank to a 25% duty, the light emitting portion 142C of the cyan tank to a 50% duty, the light emitting portion 142M of the magenta tank to a 75% duty, and the light emitting portion 142Y of the yellow tank to a 100% duty. The light emitting portion 142Y with the 100% duty is continuously illuminated. In general, if the brightness of one light emitting portion 142 is double that of the other light emitting portions 142, all the light emitting portions 142 can be made to appear equally bright by setting the light emission duty of that light emitting portion 142 at 50% and the light emission duty of the other light emitting portions at 100%. Therefore, a variation in the brightness of the display portion 122 among the ink tanks can be reduced by appropriately associating the light quantity rank information with the light emission duty.

At 50 Hz or lower, blinking of the light emitting portion 142 associated with control of the light emission duty is generally viewed as flicker. Accordingly, frequency is desirably at least 100 Hz. Further, during an A period in FIG. 7, all of the four light emitting portions 142 emit light, thus requiring a driving current for the four light emitting portions 142 to be supplied.

FIG. 8 is a timing chart illustrating another example of control of light emission from the light emitting section 142.

In the example shown in FIG. 8, to reduce a variation in brightness among the display portions 122, the following control is performed as in the case of FIG. 7: the light emitting portion 142K of the black tank is adjusted to a 25% duty, the light emitting portion 142C of the cyan tank is controlled to a 50% duty, the light emitting portion 142M of the magenta tank is adjusted to a 75% duty, and the light emitting portion 142Y of the yellow tank is controlled to a 100% duty.

The control circuit 300 sends the packet data "K-on", "C-on", "null", and "Y-on" as control data for a first section in FIG. 8. The data "K-on", "C-on", and "Y-on" are instructions for illuminating the light emitting portions 142K, 142C, and 142Y of the black, cyan, and yellow tanks. "null" indicates the absence of signals. Compared to FIG. 7, FIG. 8 shows that the light emitting portion 142M of the magenta tank is not illuminated. "K-off" in a second section is an instruction for extinguishing the light emitting portion 142K of the black tank. "M-on" is an instruction for illuminating the light emitting portion 142M of the magenta tank. Thus, while the light emitting portion 142K of the black tank is illuminating, the light emitting portion 142M of the magenta tank is not illuminated. The light emitting portion 142M of the magenta tank is illuminated after the light emitting portion 142K of the black tank is extinguished.

In a fifth section, data "M-off" and "K-on" are sent. Thus, while the light emitting portion 142M of the magenta tank is illuminating, the light emitting portion 142K of the black tank is not illuminated. After the light emitting portion 142M of the magenta tank is extinguished, the light emitting portion 142K of the magenta tank is illuminated.

During the first to fifth sections, the light emitting portion 142K of the black tank has a light emission duty of 25%. The light emitting portion 142K illuminates during 25% of the unit period and is extinguished during the remaining 75%. The light emitting portion 142M of the magenta tank is illuminated during the 75% period when the light emitting portion 142K of the black tank is extinguished. This makes it possible to reduce the number of light emitting portions 142 that illuminate simultaneously. FIG. 8 does not show any periods such as the period A in FIG. 7 when all light emitting portions 142 illuminate simultaneously. Light emission control such as that shown in FIG. 8 limits the maximum number of simultaneously illuminating light emitting portions 142 to three. It is thus only necessary to supply a driving current for up to three light emitting portions 142. This makes it possible to reduce the size of the power source mounted in the printer main body compared to the case shown in FIG. 7.

As previously described, each packet sent by the printer control circuit 300 as control data is a combination of the color ID identifying one of the mounted plural ink tanks and the signal controllably turning on and off the light emitting portion 142. The control circuit 300 can set the order in which such packets are sent. For example, the "M-off" can be sent before the "K-on" as is the case with the fifth section in FIG. 8.

Second Embodiment

Figure 9A:
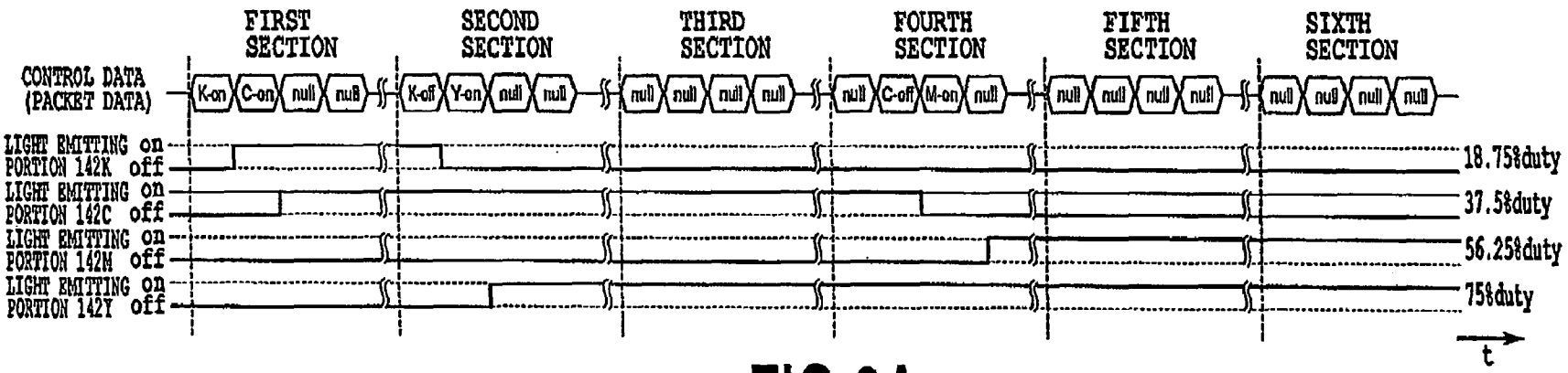
FIGS. 9A and 9B are timing charts illustrating an example of the relationship between a control signal from a control circuit in an ink Jet printer in accordance with a second embodiment of the present invention and light emission timings for light emitting portions provided in ink tanks.
Figure 9B:
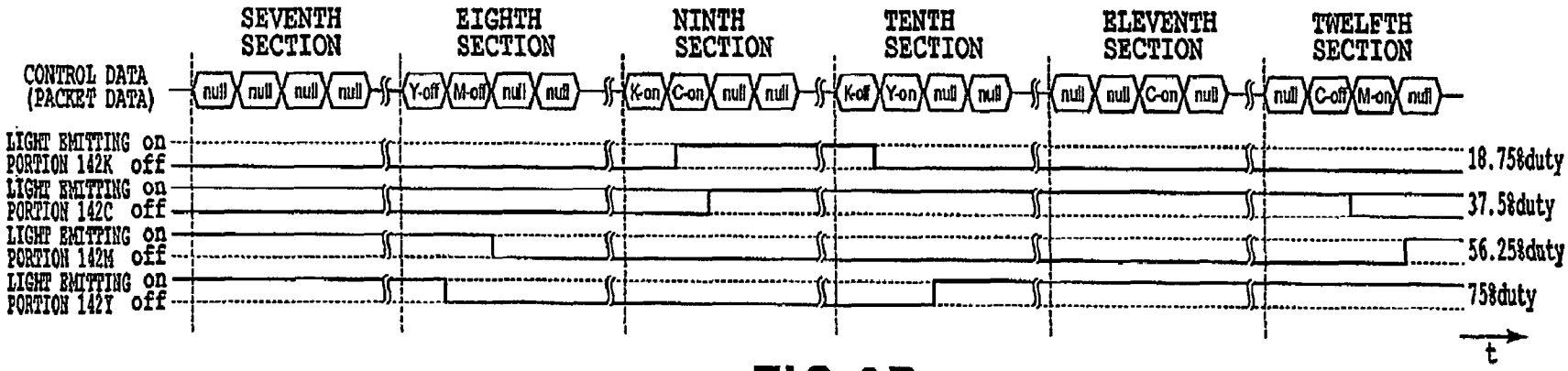

FIGS. 9A and 9B are timing charts illustrating light emission control in accordance with a second embodiment of the present invention.

The light emission control in the present example is performed if the current supplied to the substrate 141 in each ink tank by the printer control circuit 300 is limited. In the present example, the maximum value of the supplied current is 20 mA and the driving current for the single substrate 141 is 10 mA. The light emission control shown in FIG. 7 requires a maximum current of 40 mA for four light emitting portions 142 to be supplied. The light emission control shown in FIG. 8 requires a maximum current of 30 mA for three light emitting portions 142 to be supplied. The control circuit 300 that supplies a maximum current of 20 mA cannot perform light emission control such as that shown in FIGS. 7 and 8.

Thus, in the present example, the light emission duty is controlled to 18.75%, 57.5%, 56.25%, and 75% on the basis of four-rank information. These light emission duties correspond to 75% included in the light emission duties of 25, 50, 75, and 100% in the first embodiment. In FIGS. 9A and 9B, the light emitting portion 142K of the black tank is controlled to an 18.75% duty. The light emitting portion 142C of the cyan tank is controlled to a 37.5% duty. The light emitting portion 142M of the magenta tank is controlled to a 56.25% duty. The light emitting portion 142Y of the yellow tank is controlled to a 75% duty.

In a first section in FIG. 9A, the print data (packet data) "K-on" and "C-on" are instructions for illuminating the light emitting portions 142K and 142C of the black and cyan tanks. "null" indicates the absence of signals. "K-off" in a second section is an instruction for extinguishing the light emitting portion 142K of the black tank. "Y-on" is an instruction for illuminating the light emitting portion 142Y of the yellow tank. Thus, while the light emitting portion 142K of the black tank is illuminating, the light emitting portion 142Y of the yellow tank is not illuminated. The light emitting portion 142Y of the yellow tank is illuminated after the light emitting portion 142K of the black tank is extinguished.

In a fourth section, "C-off" is an instruction for extinguishing the light emitting portion 142C of the cyan tank. "M-on" is an instruction for illuminating the light emitting portion 142M of the magenta tank. Thus, while the light emitting portion 142C of the cyan tank is illuminating, the light emitting portion 142M of the magenta tank is not illuminated. After the light emitting portion 142C of the cyan tank is extinguished, the light emitting portion 142M of the magenta tank is illuminated.

In an eighth section in FIG. 9B, "Y-off" is an instruction for extinguishing the light emitting portion 142Y of the yellow tank. "M-off" is an instruction for extinguishing the light emitting portion 142M of the magenta tank.

During the first to eighth sections, the light emitting portion 142K of the black tank has a light emission duty of 18.75%. The light emitting portion 142K illuminates during 18.75% of the unit period and is extinguished during the remaining 81.25%. The light emitting portion 142Y of the yellow tank is illuminated at a light emission duty of 75% during the 81.25% period when the light emitting portion 142K of the black tank is extinguished. This makes it possible to reduce the number of light emitting portions 142 that illuminate simultaneously. Further, during the first to eighth sections, the light emitting portion 142C of the cyan tank has a light emission duty of 37.5%. The light emitting portion 142C illuminates during 37.5% of the unit period and is extinguished during the remaining 62.5%. The light emitting portion 142M of the magenta tank is illuminated at a light emission duty of 56.25 during the 62.5% period when the light emitting portion 142C of the cyan tank is extinguished. This makes it possible to reduce the number of light emitting portions 142 that illuminate simultaneously.

Light emission control such as that shown in FIGS. 9A and 9B limits the maximum number of simultaneously illuminating light emitting portions 142 to two. It is thus only necessary to supply a driving current for up to two light emitting portions 142. Even the control circuit 300 that supplies a maximum current of 20 mA can control light emission from the four light emitting portions 142. The light emission duties lower than those in FIGS. 7 and 8 enable a corresponding reduction in supplied current.

As previously described, the mobile printer is limited in supplied current. However, light emission control such as that shown in FIGS. 9A and 9B enables control with the supplied current reduced. Since the light emission duties in FIGS. 9A and 9B are lower than those in FIGS. 7 and 8, the quantity of light emitted to make the display portions 122 to appear darker. However, human eyes are sensitive to relative light quantity but not to absolute light quantity. For example, the user sensitively feels a difference in light quantity among the ink tanks mounted on the same carriage adjacent to one another. However, if the display portions 122 of the plural ink tanks mounted on the same carriage have an almost equal light quantity, the user is unlikely to have a sense of incongruity even with a slightly darker display portion 122.

Figure 10A:
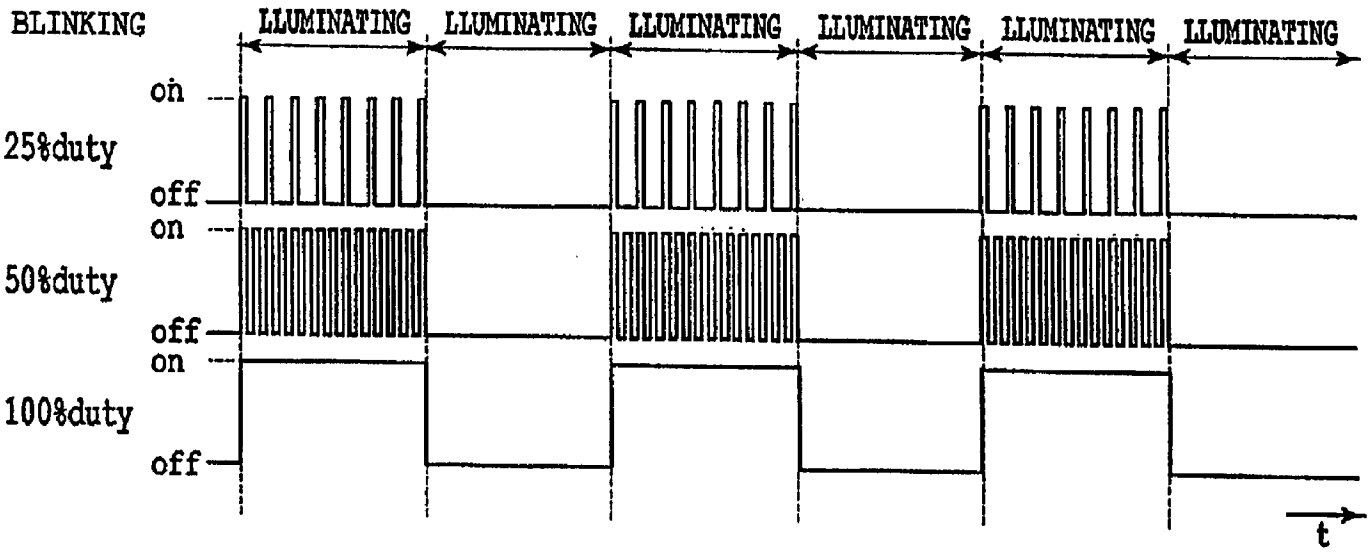
FIGS. 10A and 10B are timing charts illustrating examples of light emission patterns of the light emitting portions provided in the ink tanks.
Figure 10B:
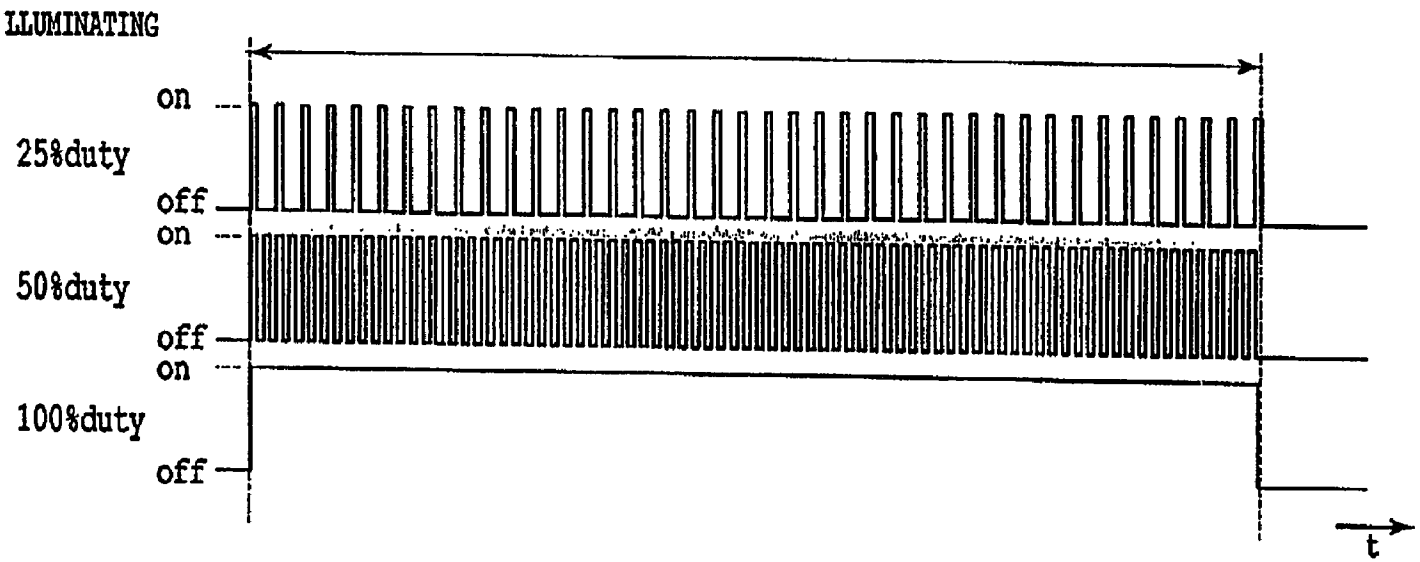

FIGS. 10A and 10B are timing charts illustrating light emission patterns of the light emitting portion 142. An illumination period in FIG. 10A corresponds to the period when the light emitting portion 142 illuminates at a predetermined light emission duty under the light emission control shown in FIGS. 7 to 9, previously described. FIG. 10A shows an example in which the user can perceive three blinks of the light emitting portion 142. FIG. 10B shows an example in which the user can perceive the continuous illumination of the light emitting portion 142. FIGS. 10A and 10B show the light emission conditions at light emission duties of 25, 50, and 100%. The driving pulse for the light emitting portion 142 is thus modulated to control the rates of the light emission period and light emission halted period during the unit time, thus adjusting the visually perceived brightness. A print duty of 100% causes the light emitting portion to be always illuminated; the extinction of the light emitting portion is avoided. A combination of the light patterns in FIGS. 10A and 10B enables the display portion 122 to appear to be illuminating or blinking. The combination further makes it possible to reduce a variation in brightness among the ink tanks to allow the information on the ink tanks to be correctly presented, as previously described.

Other Embodiments

In the above embodiments, light from the light emitting portion 142 is guided through the light guiding portion 121, provided in the ink tank, to the display portion 122, which is viewed by the user. However, the user can directly view the light emitting portion 142 by placing, if possible, the light emitting portion 142 where it is easily seen by the user. In this case, the variation among the light guiding portions 121 is excluded, so that the light quantity rank information corresponds to a variation in the quantity of emitted light among the light emitting portions 142.

According to the present invention, the functional portion that controls the LED (light emitting portion) on the basis of signals from the printer (printing apparatus) may be a module of the ink tank (liquid container). The module can be composed of, for example, the LED 101 and semiconductor substrate 120 and may include the contact 102. In short, any module may be used which can be incorporated into the ink tank to drive the LED 101 via the LED driver (driving portion) 103C during a period different from one when a signal from the printer is input to the ink tank, on the basis of that input signal.

The light emitting portion such as a LED provided in the ink tank enables the optical indication of various pieces of information including the ink remaining amount and the ink tank installation condition.

The ink tank may house and supply various treatment liquids to the printer. The treatment liquids, for example, insolubilize or aggregate the color material in the ink or improve the waterproofness of the print surface. The present invention is widely applicable as a liquid container that houses various liquids.

The present invention has been described in detail with respect to preferred embodiments, and it will now be apparent from the foregoing to those skill in the art that changes and modifications maybe made without departing from the invention it its broader aspects, and it is the intention, therefore, that the appended claims cover all such changes and modifications.

This application claims priority from Japanese Patent Application No. 2005-183982 filed Jun. 23, 2005, which is hereby incorporated by reference herein.

What is claimed is:

1. A method for controlling a light emitting portion for a liquid container in a printing apparatus that can print an image using a liquid supplied from a plurality of liquid containers, the method individually controlling the light emitting portions provided in the respective liquid containers, the method comprising the steps of:

causing the plurality of light emitting portions to emit light, and modulating a driving pulse for each of the plurality of light emitting portions to control rates of a light emission period and a light emission halted period during a unit time, wherein the light emission period of at least one of the plurality of light emitting portions is set to overlap the light emission halted period of at least another one of the plurality of light emitting portions, and wherein the plurality of light emitting portions are controlled using a light emission command containing an identification code for identifying each of the plurality of light emitting portions and a control code for illuminating the light emitting portion identified by the identification code, and a light emission stop command containing an identification code for identifying each of the plurality of light emitting portions and a control code for stopping light emission from the light emitting portion identified by the identification code.

2. The method for controlling a light emitting portion for a liquid container according to claim 1, wherein each of the plurality of liquid containers comprises an information holding portion that holds individual information on the liquid container, and the individual information is used to identify each of the plurality of liquid containers to individually control the light emitting portions of the plurality of liquid containers.

3. The method for controlling a light emitting portion for a liquid container according to claim 1, wherein each of the plurality of liquid containers comprises an information holding portion that holds light quantity information on the quantity of light emitted by the light emitting portion, and the light emitting portion corresponding to the light quantity information is controlled on the basis of the light quantity information.

4. The method for controlling a light emitting portion for a liquid container according to claim 1, wherein to cause the plurality of light emitting portions to emit light, the driving pulse for each of the plurality of light emitting portions is modulated to set a current simultaneously flowing through the plurality of light emitting portions equal to or smaller than a maximum current supplied by a driving power source for the plurality of light emitting portions.

5. The method for controlling a light emitting portion for a liquid container according to claim 1, wherein the light emitting portion constitutes a module that can be mounted in the liquid container together with a signal connection portion to which a control signal from the printing apparatus can be input.

6. A printing apparatus that can print an image using a liquid supplied from a plurality of liquid containers and that can individually control light emitting portions provided in the respective liquid containers, the apparatus comprising:

a control portion which, to cause the plurality of light emitting portions to emit light, modulates a driving pulse for each of the plurality of light emitting portions to control rates of a light emission period and a light emission halted period during a unit time, and which controls the light emission period of at least one of the plurality of light emitting portions to overlap the light emission halted period of at least another one of the plurality of light emitting portions, wherein the control portion controls the plurality of light emitting portions using a light emission command containing an identification code for identifying each of the plurality of light emitting portions and a control code for illuminating the light emitting portion identified by the identification code, and a light emission stop command containing an identification code for identifying each of the plurality of light emitting portions and a control code for stopping light emission from the light emitting portion identified by the identification code.

7. The printing apparatus according to claim 6, wherein each of the plurality of liquid containers comprises an information holding portion that holds individual information on the liquid container, and the control portion uses the individual information to identify each of the plurality of liquid containers to individually control the light emitting portions of the plurality of liquid containers.

8. The printing apparatus according to claim 6, wherein each of the plurality of liquid containers comprises an information holding portion that holds light quantity information on the quantity of light emitted by the light emitting portion, and the control portion controls the light emitting portion corresponding to the light quantity information on the basis of the light quantity information.

9. The printing apparatus according to claim 6, further comprising a power source for supplying a driving current to the plurality of light emitting portions, wherein to cause the plurality of light emitting portions to emit light, the control portion modulates the driving pulse for each of the plurality of light emitting portions to set a current simultaneously flowing through the plurality of light emitting portions equal to or smaller than a maximum current supplied by the power source for the plurality of light emitting portions.

10. The printing apparatus according to claim 6, wherein the light emitting portion constitutes a module that can be mounted in the liquid container together with a signal connection portion to which a control signal from the printing apparatus can be input, and the printing apparatus comprises a signal output portion that outputs a control signal to the signal input portion.

* * * * *